United States Patent [19]

Hoffman

[11] Patent Number: 4,743,711

[45] **Date of Patent: * May 10, 1988**

[54] CABLE HAVING HAULING, ELECTRICAL AND HYDRAULIC LINES AND ELONGATED TENSILE ELEMENTS

[75] Inventor: Ernest G. Hoffman, Middlefield, Conn.

[73] Assignee: Harvey Hubbell Incorporated, Orange, Conn.

[ * ] Notice: The portion of the term of this patent subsequent to Feb. 17, 2004 has been disclaimed.

[21] Appl. No.: 922,419

[22] Filed: Oct. 23, 1986

Related U.S. Application Data

[62] Division of Ser. No. 714,272, Mar. 21, 1985, Pat. No. 4,644,094.

[51] Int. Cl.[4] ..... H01B 7/18

[52] U.S. Cl. ..... 174/109

[58] Field of Search ..... 174/47, 102 SP, 103, 174/109, 115, 117 F

[56] References Cited

U.S. PATENT DOCUMENTS

| | | | |
|---|---|---|---|
| 2,081,634 | 5/1937 | McNamee | 174/115 |
| 2,544,233 | 3/1951 | Kennedy | 174/117 R |
| 3,679,812 | 7/1972 | Owens | 174/108 |
| 3,843,829 | 10/1974 | Bridges et al. | 174/36 |
| 4,081,602 | 3/1978 | Paniri et al. | 174/103 |
| 4,196,307 | 4/1980 | Moore et al. | 174/47 |
| 4,262,703 | 4/1981 | Moore et al. | 174/47 X |
| 4,315,099 | 2/1982 | Gerardot et al. | 174/47 |
| 4,374,530 | 2/1983 | Walling | 174/47 X |
| 4,445,593 | 5/1984 | Coleman et al. | 174/117 F X |
| 4,453,035 | 6/1984 | Neuroth | 174/103 |
| 4,453,036 | 6/1984 | Neuroth | 174/103 |
| 4,454,377 | 6/1984 | Neuroth | 174/103 |
| 4,454,378 | 6/1984 | Neuroth | 174/103 |
| 4,490,577 | 12/1984 | Neuroth | 174/103 |
| 4,532,374 | 7/1985 | Neuroth | 174/103 |
| 4,644,094 | 2/1987 | Hoffman | 174/47 |

FOREIGN PATENT DOCUMENTS

| | | | |
|---|---|---|---|
| 0066910 | 12/1982 | European Pat. Off. | 174/117 F |
| 834955 | 9/1938 | France | 174/113 R |
| 1250823 | 10/1971 | United Kingdom | 174/136 |

*Primary Examiner*—Laramie E. Askin

*Attorney, Agent, or Firm*—Roylance, Abrams, Berdo & Goodman

[57] ABSTRACT

A reinforced cable having hauling, electrical and hydraulic lines. The cable has a substantially rectangular cross section and includes at least one internal support to protect these lines by resisting external compressive forces, and yet is bendable about one of its transverse axes for easy storage on and deployment from a drum. The internal support also protects the hauling lines from compressive forces applied longitudinally thereof by resisting radial displacement of the hauling lines. In one embodiment, the cable comprises an armor layer, a pair of engaged channels inside the armor layer, and a pair of corrugated supports inside the channels and fixedly spaced apart. The hauling lines, in the form of wire ropes, are located inside the corrugated supports, while the electrical lines are located inside the channels between the corrugated supports. The hydraulic lines can alternatively be located inside the channels between the corrugated supports, or inside the wire ropes. Any spaces inside the channels are filled by elastomeric material. In another embodiment, the cable comprises a rigid tubular support located between and engaging the wire ropes, and an armor layer engaging and enclosing the tubular support and the wires ropes. In this embodiment, the electrical conductor is located inside the tubular support.

6 Claims, 3 Drawing Sheets

FIG. 1.
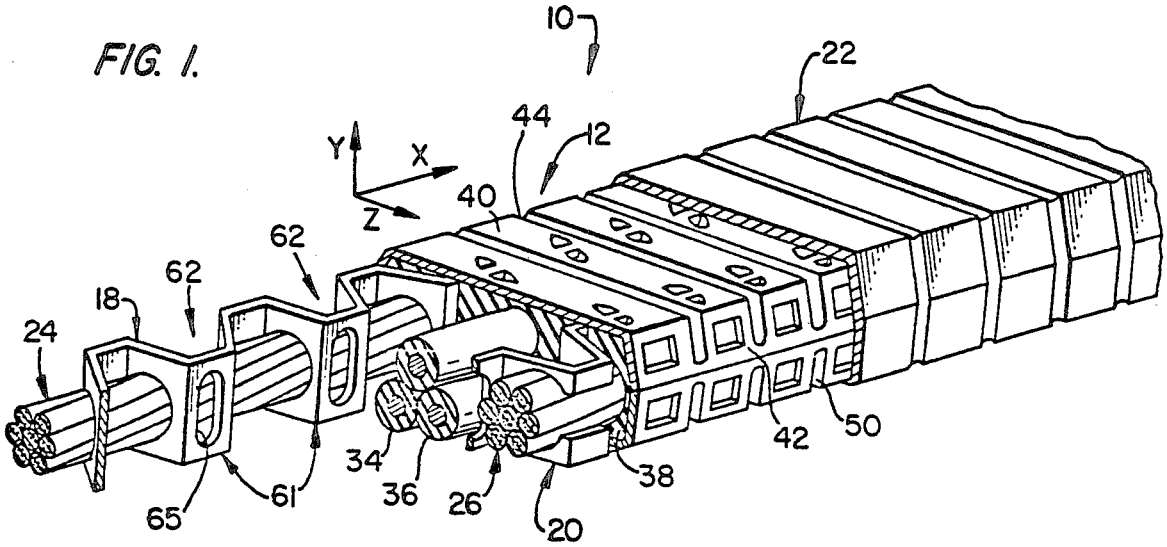
FIG. 2.
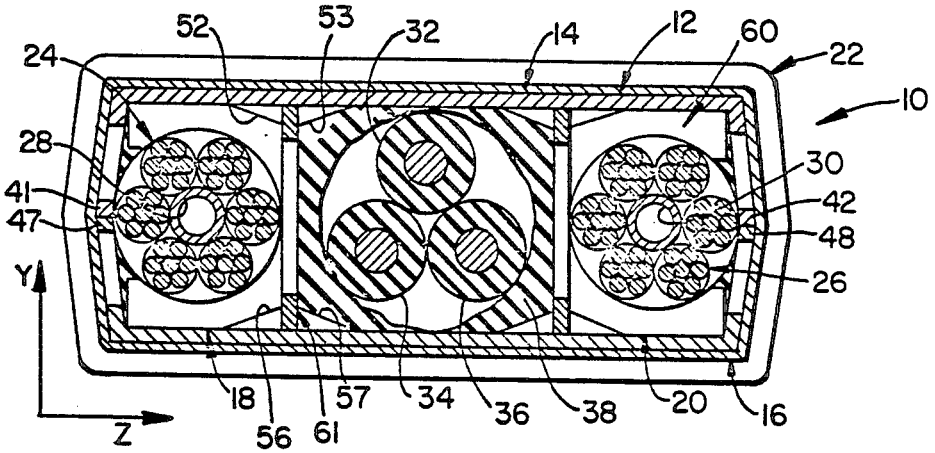
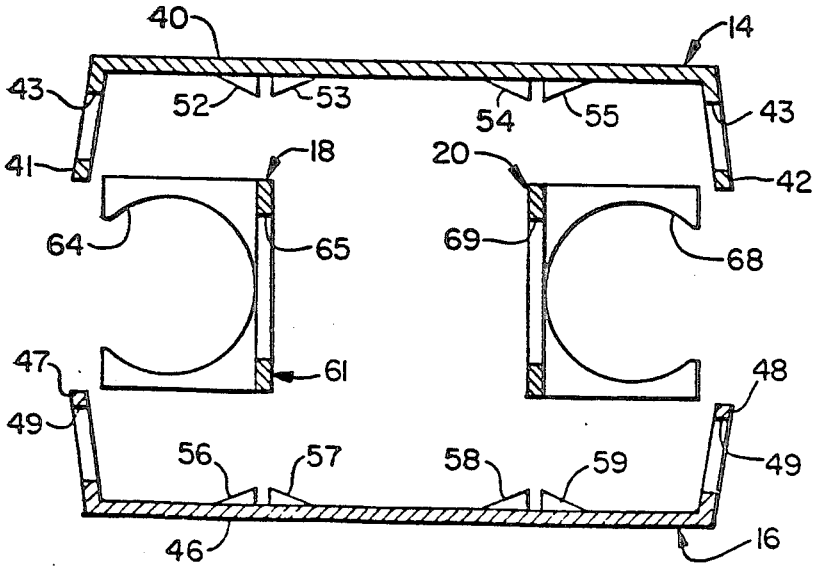
FIG. 3.

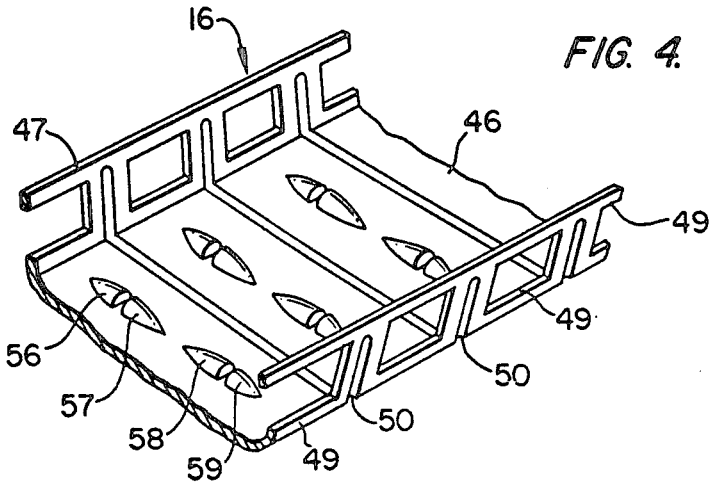
FIG. 4.
FIG. 5.
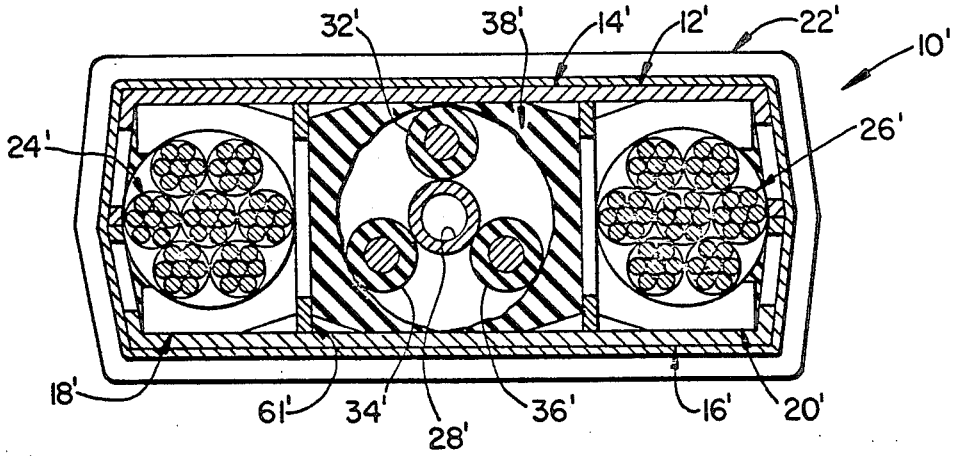
FIG. 6.
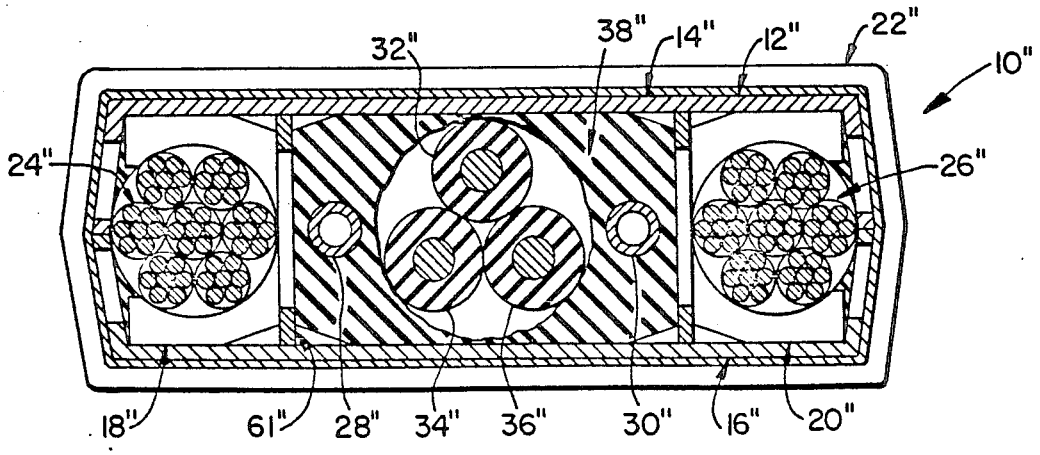

CABLE HAVING HAULING, ELECTRICAL AND HYDRAULIC LINES AND ELONGATED TENSILE ELEMENTS

This is a division of application Ser. No. 714,272 filed Mar. 21, 1985, now U.S. Pat. No. 4,644,094.

FIELD OF THE INVENTION

The invention relates to reinforced cables having hauling, electrical and hydraulic lines therein. These cables are especially useful for deploying, suspending, operating and retrieving pumps in oil wells and for providing hydraulic and electrical power to other downhole equipment. The cable in accordance with the invention includes at least one internal support to resist external compressive forces and yet is bendable about one of its transverse axes for easy storage on and deployment from a drum. The support also resists radial outward displacement of wire rope hauling lines when they experience longitudinal compression.

BACKGROUND OF THE INVENTION

Cables suitable for hauling and power and signal transmission are typically used for the installation, operation and retrieval of electrical submersible pumps used in oil wells. The conventional cable used for this purpose is generally round and comprises a core of the power and signal transmission lines surrounded by helically wound wires. There are, however, four significant disadvantages of these conventional cables.

First, under tension the helically wound wires experience significant inwardly directed forces that stress and can damage the internal core of the cable. Secondly, under compression, the helically wound wires tend to open up outwardly or inwardly, i.e. "birdcage", which distorts the strands of the wires and can inwardly compress and possibly damage the cable core. Thirdly, when such round cables contained by helically wound wires experience elevated temperatures and undergo outward expansion of the core, this again tends to generate destructive compressive stresses within the cable. Finally, these round cables cannot be winched directly onto a drum under high tension because they do not have the ability to carry out the resultant high sidewall bearing forces and therefore are easily crushed.

Other prior art cables having hauling and power and signal transmission lines are not easily bendable along the longitudinal axis and therefore are not easily stored on or deployed from a drum. Moreover, many of these cables are rather heavy and therefore do not have a high strength-to-weight ratio. They are also bulky, difficult to manufacture, and provide insufficient compression resistance.

Examples of these prior art cables are disclosed in the following U.S. Pat. Nos. 2,544,233 to Kennedy; 3,679,812 to Owens; 3,843,829 to Bridges et al; 4,081,602 to Paniri et al; 4,196,307 and 4,262,703 to Moore et al; 4,374,530 to Walling; 4,445,593 to Coleman et al; and 4,453,035 to Neuroth. In addition, an example of such prior art is disclosed in United Kingdom Pat. No. 1,250,823 to Spencer.

SUMMARY OF THE INVENTION

Accordingly, it is a primary object of the present invention to provide a reinforced cable suitable for hauling and power and signal transmission that has high tensile and compressive strength and separates the hauling lines and reinforcing structure form the power and signal transmission lines.

Another object of the invention is to provide a cable having hauling, electrical and hydraulic lines that resists external compressive impact forces, resists birdcaging under longitudinal compression, and is bendable for easy storage and deployment from a drum.

Another object of the invention is to provide such a cable that has a high strength-to-weight ratio, and is compact and easy to manufacture.

The foregoing objects are basically attained by providing an elongated cable structure having a longitudinal axis and a substantially rectangular cross-sectional shape with a top, a bottom and opposite sides, comprising a pair of elongated tensile elements of high tensile strength for supporting the cable structure in tension and having their longitudinal axes extending substantially parallel to one another and to said longitudinal axis of said cable structure and being bendable along said longitudinal axis of said cable structure, said tensile elements being spaced laterally apart and adjacent a different one of the opposite sides of the cable structure; a plurality of adjacent force-transmitting members of rigid transverse cross section on each of said tensile elements; each of said force-transmitting members having transverse arcuate portions enclosing and engaging peripheral portions of said tensile elements whereby said tensile elements are retained against displacement by said force-transmitting members; and means, bendable about an axis tansverse to said longitudinal axis, coupling said force-transmitting members in series relationship.

In the embodiments in FIGS. 1–6, the containment and reinforcing assembly comprises a pair of spaced corrugated supports receiving the wire ropes therein, a pair of engaging channels enclosing the supports and a tubular armor member enclosing the wire ropes, electrical conductor, channels and corrugated supports. In a further embodiment, in FIGS. 7–9, the containment and reinforcing assembly comprises a centrally located tubular support engaging the wire ropes and a tubular armor member enclosing the wire ropes, electrical conductor and tubular support.

Other objects,advantages, and salient features of the present invention will become apparent from the following detailed description, which, taken in conjunction with the annexed drawings, discloses preferred embodiments of the present invention.

DRAWINGS

Referring now to the drawings which form a part of this original disclosure:

FIG. 1 is a right perspective view with parts broken away of the cable in accordance with the present invention;

FIG. 2 is an enlarged transverse cross-sectional view in elevation of the cable shown in FIG. 1 with portions of the elastomeric filler deleted therefrom for clairty;

FIG. 3 is an exploded transverse cross-sectional view in elevation illustrating the upper and lower channels and the first and second supports shown in FIGS. 1 and 2;

FIG. 4 is a right perspective view of one of the channels illustrated in FIGS. 1–3;

FIG. 5 is a transverse cross-sectional view in elevation of a modified embodiment of the cable in accordance with the invention, wherein the hydraulic line is located inside a series of electrical conductors;

FIG. 6 is a transverse cross-sectional view in elevation of another modified embodiment of the invention wherein two hydraulic lines are located in the cable on opposite sides of a series of electrical conductors;

DETAILED DESCRIPTION OF THE INVENTION

Figure 7:
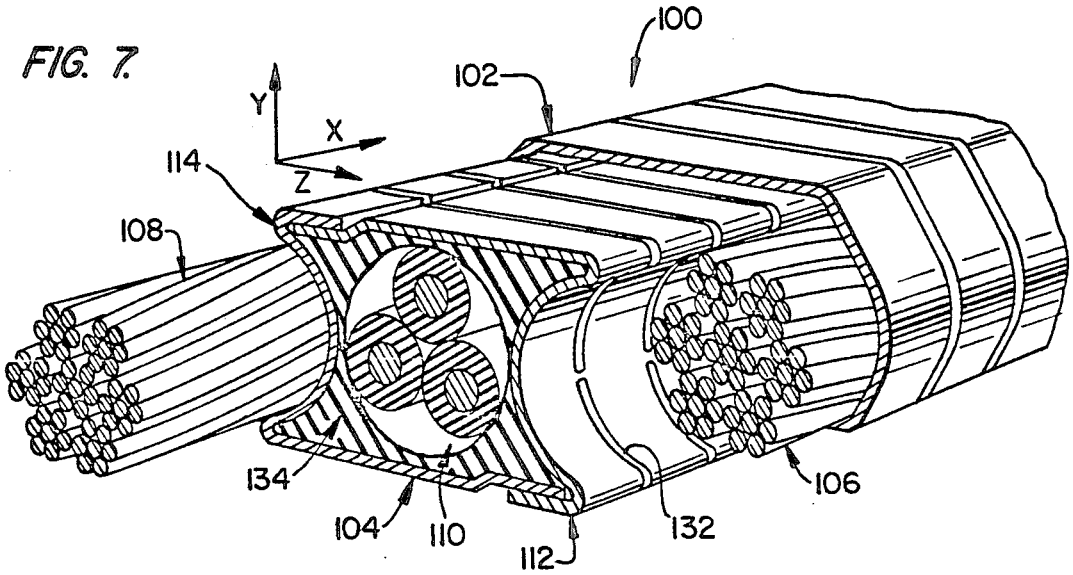
FIG. 7 is a right perspective view with parts broken away of a further modified cable in accordance with the invention using only a single internal tubular support.

As seen in FIGS. 1–4, the cable 10 in accordance with the invention is substantially flat and has a substantially rectangular cross section with a top, a bottom and opposite sides. Along its entire length, the cable comprises a tubular assembly 12 formed of upper and lower elongated channels 14 and 16, first and second elongated supports 18 and 20 each composed of a series of adjacent force-transmitting members located inside the tubular assembly, armor tape 22 wrapped around the tubular assembly forming an armor jacket enclosure, first and second hauling lines 24 and 26 located inside the first and second supports and which form a pair of elongated tensile elements, first and second hydraulic lines 28 and 30 located inside the first and second hauling lines, and electrical conductors, or power conveying lines, 32, 34, and 36 located between the first and second supports. As seen in FIGS. 1 and 2, an elastomeric filler 38 is located inside the tubular assembly to fill the spaces therein not otherwise occupied.

As best seen in FIGS. 3 and 4, the upper and lower channels 14 and 16 forming the tubular assembly 12 intercouple the supports 18 and 20 and the series of adjacent force-transmitting members thereof relative to one another. These channels 14 and 16 are substantially identical and thereforee only one will be described in detail. Thus, the upper channel 14 is substantially U-shaped in cross section, advantageously formed of metal, and is comprised of a flat central member 40 having first and second legs 41 and 42 extending in the same direction therefrom at the ends. To reduce the weight of the channels, the legs can have a series of spaced cutouts 43 formed therein. To provide bending about the axis transverse of the channel, a plurality of transversely extending slots 44 are formed completely through the central member 40 and partially through each leg.

The lower channel 16 has corresponding central member 16, legs 47 and 48, cutouts 49 and transverse slots 50.

As seen in FIGS. 3 and 4, the central member 40 in the upper channel has formed downwardly therein a first series of spaced retaining stops 52 and 53 and a second series of spaced retaining stops 54 and 55. Similar series of retaining stops 56 and 57 as well as 58 and 59 are inwardly formed on central member 46 in the lower channel. These retaining stops act in conjunction with the channels to fixedly maintain the first and second supports a fixed distance apart, as will be described in more detail hereinafter.

As seen in FIGS. 1 and 2, the upper and lower channels 14 and 16 have their respective engaging legs 41 and 47 as well as legs 42 and 48 directly engaging one another to form an elongated cavity 60 therein. This cavity has a longitudinal length along the X axis, a transverse height along a Y axis and a transverse width along a Z axis, these axes being mutaully orthogonal as illustrated in FIGS. 1 and 2. The Y axis intersects the central members 40 and 46 which are parallel and the Z axis intersects the legs on the channels. When so engaged, and wrapped with the armor tape 22 as illustrated in FIGS. 1 and 2, the upper and lower channels are substantially rigid along the Y and Z axes.

The corrugated first and second supports 18 and 20, as illustrated in FIGS. 1–3, form load bearing walls that are strong and light and rigid along the Y and Z axes. Each of the supports is the same and therefore only one will be described in detail. Thus, the first support 18 is advantageously formed of metal as a corrugation comprising a repeating series of ridges 61 and hollows 62. Each of the ridges is substantially U-shaped and formed of transversely and longitudinally oriented planar walls of rectangular shape and a common height. Each of these walls can be connected integrally with adjacent walls through an angle of 90 degrees, although the angle can be greater as illustrated in FIG. 1 since the support is essentially extensible longitudinally and bendable about the Z axis due to the corrugated nature thereof. As best seen in FIG. 3, formed along the X axis of the cavity through the transverse walls of the support 18 is a passageway defined by a series of transverse arcuate portions forming opposing jaw portions or openings 64. These openings extend substantially along the Z axis of the cavity, recieve the hauling lines therein and include substantially 270 degrees. The inner diameters of the opposing jaw portions or openings are each substantially equal to the outer fit therein, as seen in FIGS. 1 and 2. As seen in FIGS. 1 and 3, cutouts 65 can be formed in the longitudinally extending walls of the support to decrease its weight.

The second support 20 is formed substantially the same as the first support and is thus corrugated, includes ridges and hollows, has a second passageway extending therein along the X axis including arcuate openings 68, and cutouts 69.

As seen best in FIG. 2, the heights of the supports 18 and 20 along Y axis are each substantially equal to the distance between the inner surfaces of the opposed central members on the upper and lower channels. Moreover, the walls in the first and second supports which extend along the X axis of the cavity are received between the retaining stops on the upper and lower channels, thereby maintaining the first and second supports a fixed distance apart and at opposite sides of the cavity, with the first hauling line 24 engaging the left hand side of the upper and lower channels and the second hauling line 26 engaging the right hand side of the channels.

As seen in FIGS. 1 and 2, once the upper and lower channels 14 and 16 are engaged, they can be enclosed by engagement of a continuous tubular member in the form of the armor tape 22 thereon. This tape is conventional and comprises a helically wound interlocking flat metal tape that is advantageously applied with tension and is bendable about the Z axis. This tape not only holds the channels together, but it also provides an increased compressive strength to the overall structure of the cable since it produces a hoop stress when applied under tension.

The first and second hauling lines 24 and 26 are, as seen in FIGS. 1 and 2, and discussed above, received via a close fit inside the arcuate openings in the first and second supports. These hauling lines extend along the X axis of the cavity, are parallel and are contained in the plane defining a neutral axis of the cable. These hauling lines are symmetrically located in the cable, as best seen in FIG. 2.

Each of the hauling lines is advantageously a helically wound wire rope formed from a plurality of strands, which are in turn formed from a plurality of filaments. Advantageously, the two wire ropes are helically wound in opposite directions to balance the resultant torque in the cable. Since the wire ropes are recieved in the arcuate openings in the first and second supports, they act as a solid structure which is capable of resisting external compressive forces in the Y and Z directions and thus isolate the electrical conductors from these forces.

The hauling lines 24 and 26 may contain hydraulic lines. As seen in FIG. 2, the first hydraulic line 28 is located inside the first hauling line 24 in the center thereof and the second hydraulic line 30 is located centrally inside the second hauling line 26. These hydraulic lines can provide power or signals to any downhole equipment used with a downhole pump or other equipment. The hydraulic lines are also along the neutral axis of the cable. Advantageously, the strands of each wire rope are wrapped around the hydraulic line to provide added protection thereto.

The electrical conductors 32, 34 and 36 are helically wound around each other and form a triplex electrical line for conducting power or signals is formed form a conventional conducting core surrounded by suitable insulation. While three are shown, more or less can be used as desired. As seen in FIG. 2, the electrical conductors are located between the first and second corrugated supports 18 and 20 and are isolated from the hauling lines by means of these supports.

The elastomeric filler 38 is advantageously formed from rubber or suitable polymeric material and not only fills the spaces inside the cavity 60 not otherwise occupied, but also locks the various parts together to prevent longitudinal slippage of the cable components relative to each other, as well as increasing the corrosion resistance and the blocking of gas flow along the cable.

Since the first and second corrugated supports, the upper and lower channels and the armor tape are bendable about the Z axis, the cable 10 can advantageously be tightly wrapped around a drum and thereby easily deployed via a winch. Because the first and second supports, in combination with the hauling lines, provide load bearing walls that protect the electrical conductors, the cable can be winched directly onto a drum under high tension without the resultant sidewall bearing forces crushing the cable, and also the cable will resist transverse external compressive forces exerted on it during use. Moreover, since the wire ropes are received in the corrugated supports and the channels, which are enclosed in the armor layer, outward or inward radial displacement of the strands of the wire ropes is resisted when they experience longitudinal compression.

Embodiment of FIG. 5

The modified cable 10' shown in FIG. 5 is substantially the same as that shown in FIGS. 1–4; however, the hydraulic line 28' is located along the neutral axis of the cable and inside the three electrical conductors 32', 34' and 36'. In addition, the center of the hauling lines 24' and 26' is a strand of wire rather than a hydraulic line. The remaining parts of cable 10' are substantially the same as those illustrated in FIGS. 1–4 and discussed above and are shown with the same reference numerals with the addition of a prime. By placing the hydraulic line 28' between the first and second corrugated supports and away from the hauling lines, it experiences less stress.

Embodiment of FIG. 6

The modified cable 10'' shown in FIG. 6 is substantially the same as that shown in FIGS. 1–4; however, the hydraulic lines 28'' and 30'' are not located inside the hauling lines but instead are located between the corrugated supports by themselves on opposite sides of the centrally located set of electrical conductors 32'', 34'', and 36''. The remaining parts of cable 10'' are substantially the same as those shown in FIGS. 1–4 and discussed above, and bear the same reference numerals with the addition of a double prime. By providing the configuration shown in FIG. 6, the hydraulic lines are totally isolated from the hauling lines and electrical conductors so that they are not interfered with by these lines or conductors. In all events, these hydraulic lines are still maintained along the neutral axis of the cable.

Figure 8:
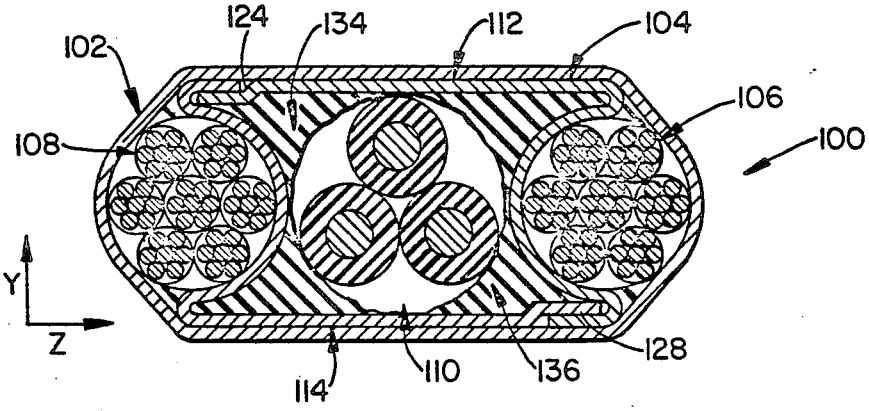
FIG. 8 is a transverse cross-sectional view in elevation of the cable shown in FIG. 7 with portions of the elastomeric filler deleted therefrom for clarity.
Figure 9:
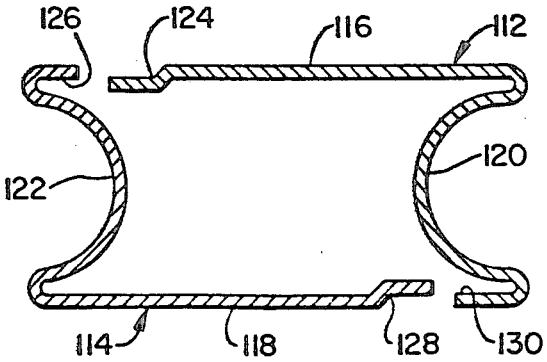
FIG. 9 is an exploded transverse cross-sectional view in elevation illustrating the two channels forming the tubular support shown in FIGS. 8 and 9.

Embodiment of FIGS. 7–9

A further modified cable 100 is shown in FIGS. 7–9 which does not use the corrugated supports or channels shown in FIGS. 1–6. Rather, cable 100 comprises a tubular armor layer 102, a central rigid tubular support or force-transmitting support member 104, a pair of wire ropes 106 and 108, and a triplex electrical conductor 110.

The tubular support 104 comprises a pair of mating channels 112 and 114, which when engaged include parallel, spaced top and bottom planar sections 116 and 118 and parallel, spaced left and right concave side sections 120 and 122. The top and right side sections can be integrally formed to comprise channel 112, and the bottom and left side sections can be integrally formed to comprise channel 114. As seen in FIGS. 7–9, the bent end 124 of top section 116 forms a tongue for reception in slot 126 formd in the left concave side section, while the bent end 128 of bottom section 118 forms a tongue for reception in slot 130 formed in the right concave side section. The resulting closed tubular support, or box, is transversely rigid along the Y and Z axes, but bendable about the Z axis due to transverse slots 132 formed therein as seen in FIG. 7.

The tubular support defines a continuous cavity 134 therein for the reception of the electrical conductor 110. The pair of wire ropes 106 and 108 have parts thereof received, respectively, in the concave side sections or transverse arcuate portions 120 and 122 of the tubular portion. Advantageously, half of each wire rope is received in the associated concave side sections to provide additional compression resistance along the Y axis. Thus, the wire ropes are fixedly spaced apart by the tubular support and have the electrical conductor located therebetween.

The armor layer 102 engages and encloses the entire length of the wire ropes and the tubular support, and is advantageously applied under tension to provide significant hoop strength. elastomeric filler material 136 fills the cable inside the armor tape not otherwise occupied.

Thus, transverse compressive forces directed at the electrical conductor are resisted by the rigid tubular support, wire ropes and armor layer. Moreover, since the wire ropes are enclosed between the armor layer and the two concave sections, outward radial displacement of the strands of the wire ropes is resisted when the ropes experience longitudinal compression. In addition, since the outer diameter of the triplex electrical conductor 110, as seen in FIG. 8, is greater than the outer diameter of the wire ropes, the overall cable has a high weight-to-strength ratio and is also compact. This is also shown in the previous embodiments illustrated in FIGS. 1–6. Likewise, cable 100 is bendable about transverse axis Z, so the cable can be wound on a drum.

As seen in FIGS. 7–9, no hydraulic line is illustrated. However, if desired, one or more hydraulic lines can be added as shown in FIGS. 2, 5, or 6.

While various advantageous embodiments have been chosen to illustrate the invention, it will be understood by those skilled in the art that various changes and modifications can be made therein without departing from the scope of the invention as defined in the appended claims.

In this regard, as used herein the term power line includes one or more individual electrical conductors.

What is claimed is:

1. An elongated cable structure having a longitudinal axis and a substantially rectangular cross-sectional shape with a top, a bottom and opposite sides, comprising:

a pair of elongated tensile elements of high tensile strength for supporting the cable structure in tension and having their longitudinal axes extending substantially parallel to one another and to said longitudinal axis of said cable structure and being bendable along said longitudinal axis of said cable structure, said tensile elements being spaced laterally apart and adjacent a different one of the opposite sides of the cable structure;

a plurality of adjacent force-transmitting members of rigid transverse cross section on each of said tensile elements;

each of said force-transmitting members having transverse arcuate portions enclosing and engaging peripheral portions of said tensile elements whereby said tensile elements are retained against displacement by said force-transmitting members; and means, bendable about an axis transverse to said longitudinal axis, coupling said force-transmitting members in series relationship.

2. An elongated cable structure having a longitudinal axis and a substantially rectangular cross-sectional shape with a top, a bottom and opposite sides, comprising:

a pair of elongated tensile elements of high tensile strength having their longitudinal axes extending substantially parallel to one another and to said longitudinal axis of said cable structure, said tensile elements being spaced laterally apart and adjacent a different one of the opposite sides of the cable structure;

a series of force-transmitting members of rigid transverse cross section mounted on each of said tensile elements and being bendable relative to one another along said longitudinal axis;

said force-transmitting members having openings transversely receiving longitudinal segments of said tensile elements; and an armor jacket formed of interlocked windings enclosing said force-transmitting members, said jacket being bendable along said longitudinal axis.

3. An elongated cable structure having a longitudinal axis and a substantially rectangular cross-sectional shape with a top, a bottom and opposite sides, comprising:

a plurality of elongated tensile elements of high tensile strength for supporting the cable structure in tension and having their longitudinal axes extending substantially parallel to one another and to said longitudinal axis of said cable structure and being bendable along said longitudinal axis of said cable structure, said tensile elements being spaced laterally apart and adjacent a different one of the opposite sides of the cable structure; and a plurality of force-transmitting members of rigid transverse cross section mounted in series on each of said tensile elements and being bendable relative to one another along said longitudinal axis;

each of said force-transmitting members having interior portions engaging peripheral portions of said tensile elements and thereby holding said peripheral portions against displacement.

4. An elongated cable structure having a longitudinal axis and substantially flat opposite faces, comprising:

at least one elongated tensile element of high tensile strength for supporting the cable structure in tension and having its longitudinal axis extending substantially parallel to said longitudinal axis of said cable structure and being bendable along longitudinal axis of said cable structure;

a plurality of force-transmitting members of rigid transverse cross section mounted in adjacency on said tensile element;

each of said force-transmitting members having a series of opposed portions transversely engaging peripheral portions of said tensile element, said force-transmitting members being bendable along said longitudinal axis;

a jacket on said force-transmitting members and being bendable therewith along said longitudinal axis; and means coupling said jacket to said force-transmitting members.

5. An elongated cable structure having a longitudinal axis and substantially flat opposite faces and sides, comprising:

a plurality of elongated tensile elements of high tensile strength for supporting the cable structure in tension and having their longitudinal axes extending substantially parallel to one another and to said longitudinal axis of said cable structure and being bendable along said longitudinal axis of said cable structure, said tensile elements being spaced laterally apart and adjacent a different one of the sides of the cable structure;

a plurality of force-transmitting members of rigid transverse cross section mounted in series on each of said tensile elements and being bendable relative to one another along said longitudinal axis; and interior arcuate portions on each of said force-transmitting members enclosing and engaging peripheral segments of said tensile elements, whereby said tensile elements are constrained against radial and lateral displacements.

6. An elongated cable structure having a longitudinal axis and a top, a bottom and opposite sides, comprising:

a pair of elongated tensile elements of high tensile strength for supporting the cable structure in tension and having their longitudinal axes extending substantially parallel to one another and to said longitudinal axis of said cable structure and being bendable along said longitudinal axis of said cable structure, said tensile elements being spaced laterally apart and adjacent a different one of the opposite sides of the cable structure;

a plurality of force-transmitting members of rigid transverse cross section mounted on each of said tensile elements and being bendable relative to one another along said longitudinal axis;

said force-transmitting members having a series of transversely opposing jaw portions transversely enclosing and engaging lengths of said tensile elements whereby said tensile elements are restrained against radial and lateral displacement;

enclosure enclosing said force-transmitting members, said enclosuree means being bendable along said longitudinal axis; and means, between said enclosure means and said force-transmitting members, intercoupling said enclosure means and said force-transmitting members.

* * * * *